United States Patent [19]

Silva et al.

[11] Patent Number: 4,707,248

[45] Date of Patent: Nov. 17, 1987

[54] PROCESS FOR THE RETORTING OF HYDROCARBON-CONTAINING SOLIDS

[75] Inventors: Julio C. Silva; Ubirajara Gaiao; Rubens E. M. Novicki, all of Parana, Brazil

[73] Assignee: Petroleo Brasileiro S.A., Rio De Janeiro, Brazil

[21] Appl. No.: 662,739

[22] Filed: Oct. 19, 1984

[30] Foreign Application Priority Data

May 27, 1983 [BR] Brazil ..... 8302810

[51] Int. Cl.[4] ..... C10G 1/02; C10B 53/06

[52] U.S. Cl. ..... 208/409; 208/410; 201/31

[58] Field of Search ..... 208/11 R, 8 R, 409, 208/410; 201/31

[56] References Cited

U.S. PATENT DOCUMENTS

| | | | |
|---|---|---|---|
| 1,627,162 | 5/1927 | Egloff | 208/11 R X |
| 2,701,787 | 2/1955 | Hemminger et al. | 208/11 R X |
| 2,725,347 | 11/1955 | Leffer | 208/11 R |
| 3,140,240 | 7/1964 | Fowler, Jr. | 201/31 X |
| 3,501,394 | 3/1970 | Lyons | 208/11 R |
| 4,088,502 | 5/1978 | O'Frill | 208/11 R |
| 4,243,511 | 1/1981 | Allred | 208/11 R |
| 4,388,173 | 6/1983 | Escher et al. | 208/11 R |
| 4,415,431 | 11/1983 | Matyas | 208/8 R |
| 4,459,201 | 7/1984 | Eakman et al. | 208/11 R |

OTHER PUBLICATIONS

"Chemical Engineer's Handbook", Perry, 5th ed. McGraw-Hill, 1973, pp. 119-22: 19-24.

*Primary Examiner*—Glenn Caldarola

[57] ABSTRACT

The invention relates to a hydrocarbon-containing solids retorting process, such as, for example, shale, coal, tar sands, etc., the particles of which are below 6 mm in size, at a vertical entrainment regime, with superheated steam.

As an alternative to the process, the preheating of the solid charge to be fed to the reactor is foreseen, by a stream of retorted solids, removed from the primary separator, when effecting separation of the solid and gaseous phases from the retorting products. Heat exchange to the reactor is augmented by the use of static mixing devices provided in said reactor.

4 Claims, 2 Drawing Figures

PROCESS FOR THE RETORTING OF HYDROCARBON-CONTAINING SOLIDS

The present invention relates to a process for the retorting of solids, such as, for example, shale, coal, tar sands, etc., under a vertical entrainment regime, employing superheated steam.

More specifically, the invention relates to a retorting process for hydrocarbon-containing solids, whose particles are below 6 mm in size. The present invention is particularly directed to a process for retorting shale fines at a vertical entrainment regime, utilizing superheated steam.

The vast worldwide natural shale deposits contain a large organic matter reserve, which is decomposed under pyrolysis conditions, yielding oil, gas and residual carbon. The oil producing potential of these deposits by far exceeds the world's known petroleum reserves.

Among the recognized oil recovery processes for surface shale, regardless of the heat carrier circulation mode, there are two that can be regarded as basic: those processing granular solids and those processing fines.

One disadvantage of the processes for retorting granular solids is that they require a homogeneous blending of the solids with the heat carrier, in order that high organic matter recovery rates be achieved. In most cases, the heated carrier will either comprise the gases generated by direct combustion of the pyrolisis residue, or an indirectly heated gas stream circulating through the porous bed comprised of the solid material. As a consequence, the fines content within the reactor in these processes is restricted to a maximum level, the excess being rejected. The extent of fine rejection will depend on the mechanical strength of the feed, and the type of process used.

On the other hand, the fines retorting processes employ, as a rule, solid materials, as for example, sand, ceramic balls, calcined shale, etc., as heat carriers. In addition, they utilize the classical fluidized flow concept, or else, employ recycling. There are considerable problems arising from such procedures.

One disadvantage of such processes relates to equipment erosion, caused by the friction of the small solid particles at high speed against the equipment walls.

Another disadvantage, especially when the heat carrier is a calcined solid, is that there is a drop in the yield of liquid products, due to the increase in active surface area of the material, that is, the material is more porous, causing the adsorption of volatile products on the surface of the heat carrier, giving rise to cracking phenomena and a consequent increase in the yield of gas and carbon residue. Further, there is a difficulty in maintaining the classical fluidized flow, on account of the wide particle size range of the fines material—generally comprising particles less than 6 mm in size.

One object of the present invention process is the retorting of hydrocarbon-containing solids through the entrainment of the solids by superheated steam.

Another object of the process according to the invention, is the retorting of hydrocarbon-containing solids, the particles whereof are below 6 mm in size.

A further particular object of the process according to the present invention is the retorting of shale fines, by contacting thereof with superheated steam, under a vertical entrainment regime.

The hydrocarbon-containing solids retorting process of the invention comprises the following steps:

(a) contacting the solid particles with superheated steam;

(b) upward transport of the mixture obtained in the previous step, at a gas velocity near the critical impact velocity, through a multi-tube vertical reactor, immersed in a vertical furnace, kept at a temperature in the range of 800° to 1,000° C.;

(c) heating said mixture to the solid's pyrolisis temperature, by means of the heat generated by the burning of fuel in the vertical furnace and supplied to said mixture through the walls of said reactor;

(d) removing the products from the reactor, separating the solid phase from the retorting products, forcing the passage of said products through primary and secondary separators, keeping the temperature at high levels, that is, above the dew points of the vapors;

(e) removing the gaseous phase from the retorting products exiting the secondary separator, by carrying out a second separation stage, for the purpose of obtaining fuel gas and oil.

One advantage of the shale fines retorting by the process in accordance with the present invention, is the ease of increasing the processing flow rates. Since the reactor is of the multi-tube type, if a processing flow rate increase is desired, it suffices to increase the number of tubes in the reactor, without the need of changing the process plant, that is, the need of further equipment addition.

A further advantage of the process according to the present invention is the high solids carrying capacity of the carrier gas, in this case, superheated steam. This is a characteristic feature of vertical entrainment regimes, wherein, depending on the solids concentration, for a given carrier gas velocity, several operating conditions are possible, as from transport in a dilute phase, up to that performed in a dense phase.

In reactors operating with the horizontal transport regime, there ordinarily results a deposition of the heavier particles on the reactor walls, which causes constant clogging problems. Furthermore, it becomes impossible to substantially increase the flow rate of the carrier gas in order to overcome the particles' weight, because of the rapidly increasing friction of such particles against the reactor walls, leading to quick destruction of the equipment.

In the process of the present invention, the flow velocity of the superheated steam is controlled, so as to enable the upward carrying of the solids and steam mixture through the reactor at a gas transport velocity near the critical impact velocity. In the particular embodiment of the invention wherein shale particles with a size less than 6 mm are processed, the gas transport velocity is in the range of 6 to 10 m/s.

A further advantage of the process according to the present invention is the possibility of working with solids of a wide range of particle size. As the process utilizes vertical transport, even with collision occurring among the particles and the formation of regions with a high solid concentration, the weight of these concentrates will by itself, act as a gas flow regulating factor, since the reduction in the reactor tube cross-section will cause a gas flow velocity increase at such points, which, as a consequence, will bring about a further entrainment of the particles forming such concentrate. In this region, a more effective heat exchange between the surrounding particles and the reactor walls is also observed.

As a consequence of observing such a phenomenon, suitably spaced static devices have been provided inside the reactor tube. These devices are built in a fashion such as to cause partial plugging of the reactor tube, yet allowing the passage of solid particles and steam. Steam, on passing through the openings formed between said device and the reactor wall, will form bubbles, causing the solid particles to flow over the bubble surface and bringing said particles close to the reactor walls, thus increasing heat exchange efficiency.

Another advantage of the process according to the present invention is the short residence time required for retorting. In the case of shale fines retorting, this time was found to range from 10 to 80 seconds.

For a better understanding of the invention, the process will now be described by reference to the figures accompanying the specification.

BRIEF DESCRIPTION OF THE DRAWINGS

As shown in FIG. 1, fine crude shale (1) initially undergoes a moisture-removing treatment, in a dryer (2), prior to feeding to multi-tube vertical reactor (6)—hereinafter referred to, in short, as reactor. The dried shale (3) is supplied to reactor (6) through an inert gas (27) sealed screw feeder (4) and a mixing valve (5), where it contacts superheated steam (26) at a temperature in the range of from 400° to 500° C., supplied from a waste heat boiler (25). The shale and superheated steam mixture, is then carried upwards through reactor (6), flowing at a gas flow velocity in the range of 6 to 10 m/s.

Figure 1:
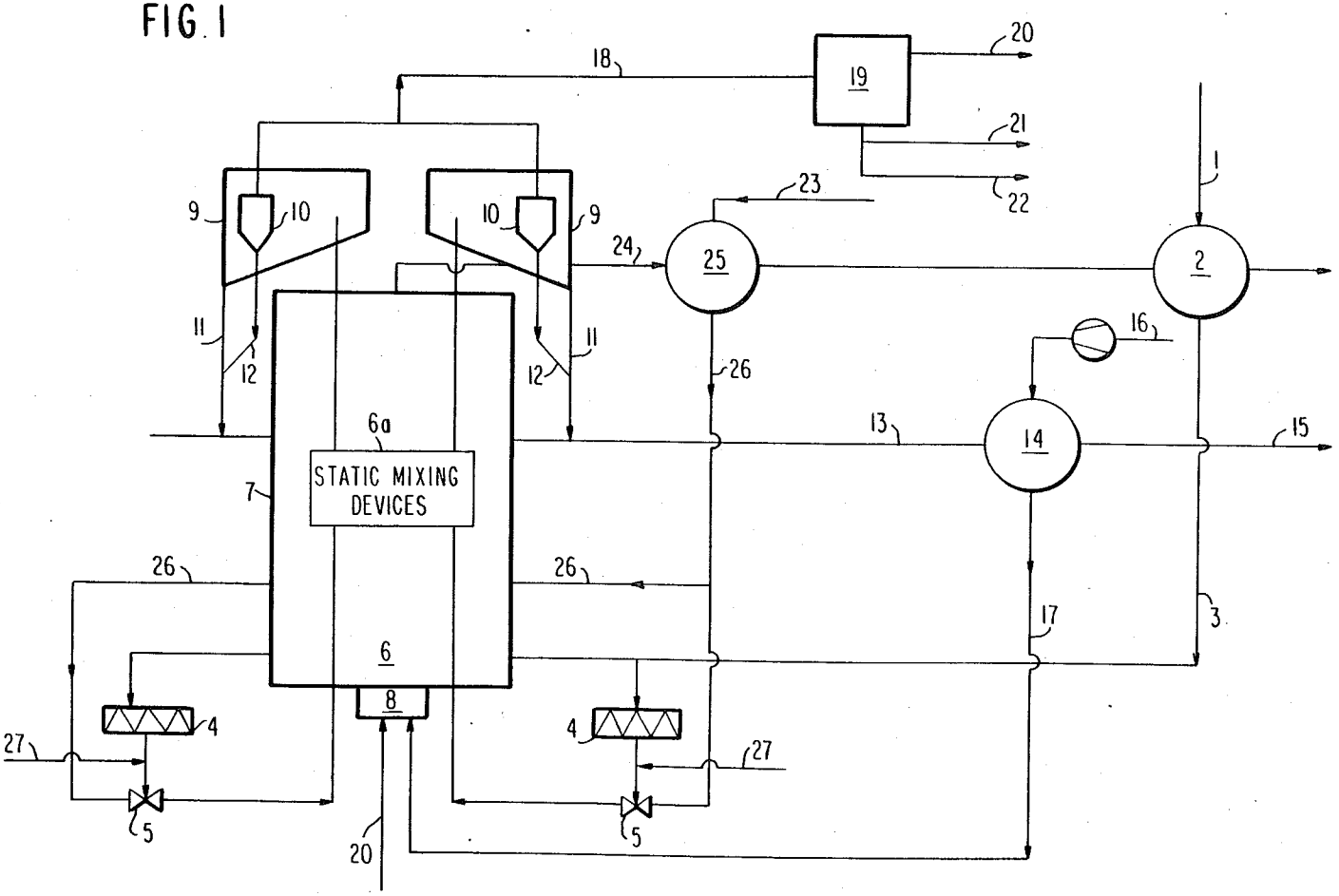
In FIG. 1, the process steps are schematically represented.

Reactor (6) is immersed in a vertical furnace (7), heated to a temperature in the range of 800° to 1,000° C., that will supply heat through the walls of reactor (6), thus enabling the retorting of the shale and, as a consequence, releasing the hydrocarbons contained in the particles thereof. Retorting of shale is carried out in a temperature range of 550° to 650° C., at pressure levels ranging from 0.9 to 1.5 atm. absolute.

In order to improve the internal heat exchange coefficient of reactor (6) and vertical furnace (7), static devices (6*a*) are provided inside the tubes of reactor (6), suitably spaced apart, so as to redistribute the superheated steam flow, used in the process solely as a carrier gas, and bringing the solids particles into closer proximity to the reactor walls.

The reaction products, on exiting reactor (6), are sent to a solids separation step, carried out at high temperature levels, which allows the solid and gaseous phases to be separated without occurrence of volatile product condensation. To accomplish the solids separation step, the retorting products are forced into a primary separator (9), containing a high efficiency cyclone assembly (10), which effects the secondary separation of the solids, that is, captures the smallest particles, that have not been trapped in primary separator (9).

The solid phase—retorted shale (11, 12)—is removed, still hot, from the primary (9) and secondary (10) separators, passing through a combustion air preheater (14), where it exchanges heat with the air, and after cooling (15), can be disposed of or else, sent to a combustion step not shown in the figure.

The gaseous phase (18), on leaving the aforementioned cyclone secondary separator (10), goes to a second separations stage (19), yielding a fuel gas (20)—which is then sent to a sulphur separating unit (not shown in the figure), and will be later used in burner (8) of vertical furnace (7)—as well as oil (21) and water (22).

Combustion air (17), supplied to the vertical furnace (7), to burn with fuel gas (20), comes from an external source (16) and is previously heated by indirect heat exchange in the above-mentioned preheater (14).

The combustion gas (24) from vertical furnace (7) is sent to a waste heat boiler (25) where the carrier superheated steam (26) is generated from the boiler water (23), and from there, to dryer (2) for fine crude shale (1).

Figure 2:
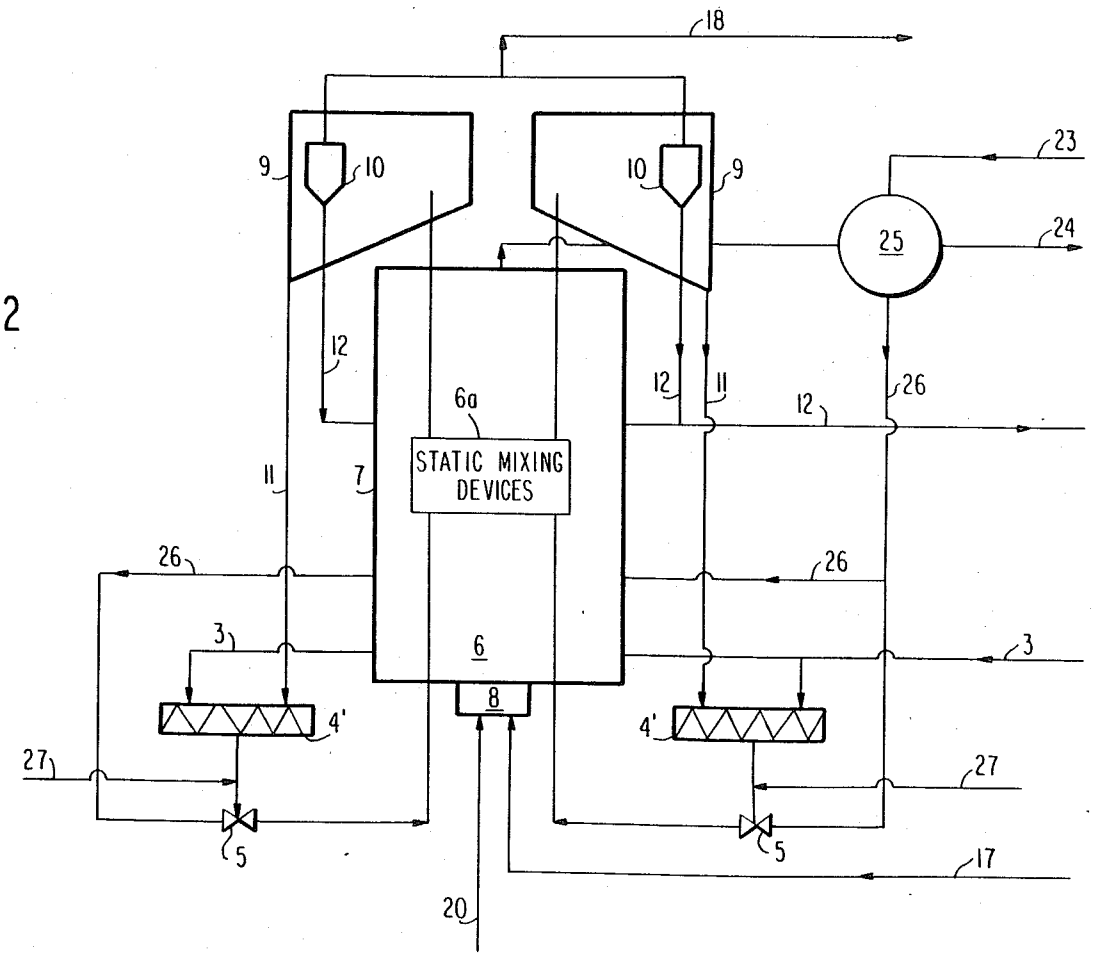
FIG. 2 presents an alternative to the process, aiming at an improved heat exchange efficiency within the reactor.

In FIG. 2, an alternative for improving the heat exchange conditions within the reactor is shown. This comprises utilizing a portion of the retorted shale for preheating the dried crude shale feed supplied to the reactor. Thus, according to FIG. 2, the solids stream (11) exiting primary separator (9), is blended with the dried crude shale (3) being fed to screw feeder (4'). The retorted shale (11) and dried crude shale (3) mixture, on leaving screw feeder (4'), passes through mixing valve (5) and is entrained by superheated steam (26), into reactor (6).

It will be understood by those skilled in the art, that, depending on the characteristics of the solids to be retorted, changes in the pyrolysis temperature conditions can be made, for the purpose of accommodating a production plan for products of regional interest, with maximization of liquid and gaseous products being achieved through influencing the conditions within the reactor.

What is claimed is:

1. A process for the retorting of hydrocarbon-containing solids, characterized in that it comprises the following steps:

(a) contacting the solid particles with superheated steam;

(b) transporting, in an upward direction, the mixture obtained in the previous step, at a gas velocity close to the critical impact velocity, through a vertical multi-tube reactor, immersed in a vertical furnace, held at a temperature in the range from 800° to 1000° C.;

(c) heating said obtained mixture to the solids' pyrolysis temperature, by means of the heat generated by the burning of fuel inside the vertical furnace and supplied to said mixture through the walls of said reactor;

(d) removing the products from the reactor, separating the solid phase from the retorting products, by forcing said products to pass through primary and secondary separators, holding the temperature at a high level, above the dew point of the vapors;

(e) removing the gaseous phase from the retorting products exiting the secondary separator thus effecting a second separation stage, for the obtaining of fuel gas and oil said process further characterized in that spaced static devices are provided within the multi-tube reactor tube, so as to cause the solid particles to come close to the walls of said reactor, as a consequence of the superheated steam flow redistribution in order to increase heat transfer between said vertical furnace and said reactor walls.

2. A process for the retorting of hydrocarbon-containing solids, in accordance with claim 1, characterized in that the solid charge to be fed to the reactor is preheated, by mixing said charge with a stream of solids exiting from the primary separator.

3. A process for the retorting of hydrocarbon-containing solids, in accordance with claim 1 or 2, characterized in that the solid particles are shale fines, with a particle size below 6 mm.

4. A process for the retorting of hydrocarbon-containing solids, in accordance with claim 1 or 2, characterized in that the shale particles are retorted at a vertical upward entrainment regime, utilizing superheated steam at a temperature within the range of 400° to 500° C., flowing at a gas flow velocity within the range of 6 to 10 m/s, the retorting being effected in a temperature range of from 550 to 650° C., under pressure conditions ranging from 0.9 to 1.5 atm. absolute and a solid material residence time within the reactor, ranging from 10 to 80 seconds.

* * * * *